United States Patent [19]

Boismard

[11] 3,996,871

[45] Dec. 14, 1976

[54] HYDROPLANING HULLS AND VESSELS EMPLOYING THE SAME

[75] Inventor: Pierre Boismard, Paris, France

[73] Assignee: Sexta-Etudes et Recherches, Callian, France

[22] Filed: Apr. 11, 1975

[21] Appl. No.: 567,422

Related U.S. Application Data

[63] Continuation-in-part of Ser. No. 380,593, July 19, 1973, abandoned.

[52] U.S. Cl. ..... 114/66.5 R; 114/61

[51] Int. Cl.[2] ..... B63B 1/20

[58] Field of Search ..... 114/56, 66.5 R, 61, 114/63, 66.5 F; 9/6

[56] References Cited

UNITED STATES PATENTS

| | | | |
|---|---|---|---|
| 942,687 | 12/1909 | White | 114/61 |
| 1,888,107 | 11/1932 | Batt | 114/66.5 R |
| 2,400,771 | 5/1946 | Moxham | 114/56 X |
| 2,519,793 | 8/1950 | Rowe | 114/56 |
| 2,666,406 | 1/1954 | Babcock | 114/61 |
| 3,085,536 | 4/1963 | Teetor | 114/61 |
| 3,298,343 | 1/1967 | Juhnke | 114/56 |

*Primary Examiner*—Trygve M. Blix
*Assistant Examiner*—Gregory W. O'Connor

[57] ABSTRACT

A multi-hulled vessel and the hull design for the hulls of a multi-hulled vessel capable of operating as a hydroplane are presented. Each of the hulls of the multi-hulled vessel are of hydrostatically and hydrodynamically identical configuration. The forward portions of the oppositely disposed sidewalls of the hull are conically shaped and the rearward portions are planar; the forward portion of the base of the hull is cylindrically shaped and the rear portion is planar; and the stern is planar. The two conically shaped front portions of the hull sidewalls are interconnected at an acute angle by a common generatrix which forms the front bow or stem of the hull, and the cylindrical portion of the base of the hull has a horizontal generatrix. The conical sidewall portions and the cylindrical base portion are each tangent to their respective rearwardly disposed planar elements.

12 Claims, 19 Drawing Figures

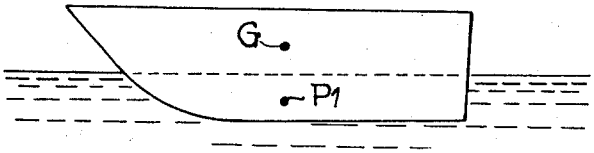
FIG. 9.1
PRIOR ART
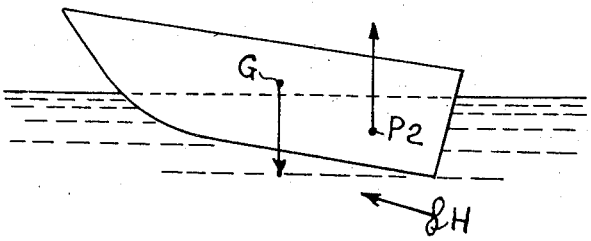
FIG. 9.2
PRIOR ART
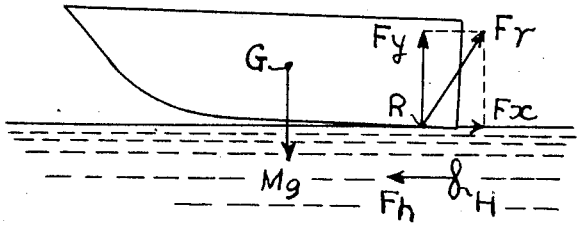
FIG. 9.3
PRIOR ART
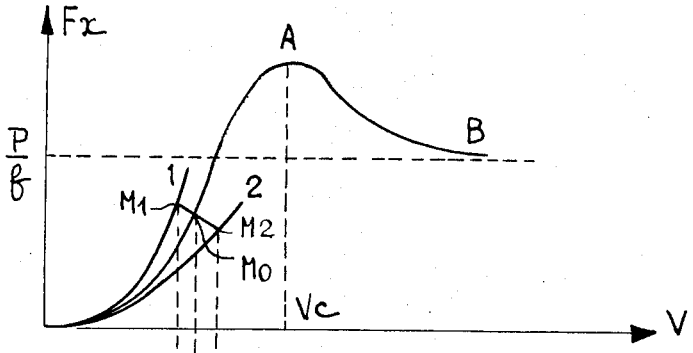
FIG. 10.1
PRIOR ART
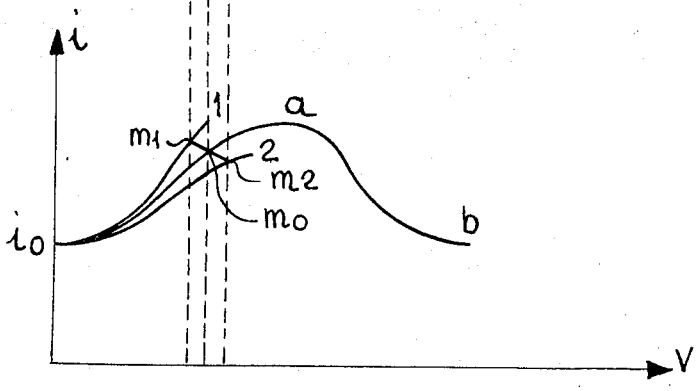
FIG. 10.2
PRIOR ART

HYDROPLANING HULLS AND VESSELS EMPLOYING THE SAME

CROSS-REFERENCE TO RELATED APPLICATIONS:

This application is a continuation-in-part of U.S. application Ser. No. 380,593, filed July 19, 1973, now abandoned.

BACKGROUND OF THE INVENTION:

1. Field of the Invention

The present invention relates to multi-hulled nautical vessels and to the design of hulls for multi-hulled nautical vessels. More particularly, this invention is directed to hulls for vessels of the type having at least three hulls which define a floating polygon having a longitudinal axis of symmetry and being capable of navigating as a hydroplane. Accordingly, the general objects of the present invention are to provide novel and improved methods and apparatus of such character.

2. Description of the Prior Art

Single-hull vessels intended to navigate under hydroplane conditions are, of course, well known. Such prior art vessels are typically driven by means of a propeller in such a manner that the thrust axis produces a torque tending to cause the hulls to "rear." When running at high speed a trim of balance is sought in which the buoyancy tends to be of a hydrodynamic rather than hydrostatic nature. However, the balance remains essentially dynamic at high speeds. Any fluctuations in the operating conditions, for example a variation in the thrust provided by the engine or a change in the reaction between the hull and the fluid medium as will be caused by choppy seas, will disturb the balance of the vessel. Any disturbance of balance will cause the vessel to dip and thus subject the hull to considerable shocks upon its re-decent into the water. As is well known, such shocks reduce the performance of the vessel and are liable to damage the hull. The lateral stability of prior art single-hull hydroplane vessels is also very mediocre and can only be improved through the use of longitudinal keel devices which, as is well known, have a deleterious effect on the main performance of the vessel. In the case of vessels employed for racing, the hulls are known to rear excessively to the point where the vessel may turn over and control is lost in turns at an excessive angular velocity.

Stepped hulls have previously been proposed in an effort to overcome the above briefly discussed deficiencies of prior art single-hull hydroplane vessels. The previously proposed stepped hulls, however, have not resulted in any improvement in lateral stability nor have they provided the requisite characteristics required for operation over rough seas.

The above discussed deficiencies of the prior art are an inherent result of the design configurations of prior art hulls. An analysis of a rectangular plate, partially immersed in liquid, may be considered to study the principle of hydroplane navigation and understand the problems of the prior art.

Referring to FIG. 1, a rectangular plate having a wetted surface area S is shown partially immersed in a liquid and is considered to be moving through the liquid from right to left as shown with a velocity V. L is the longitudinal length of the wetted (i.e. immersed) surface, 1 is the width of the immersed surface, C is the center of the thrust, and i is the angle of inclination of the plate with respect to the surface of the liquid. The plate exerts a reaction force $K_r$, presenting a vertical component $K_y$ and a horizontal component $K_x$. A rectangular plate with the surface S, entirely immersed in a liquid and moved perpendicularly in this liquid at the speed V will exert an antagonistic reaction force defined by:

$$R = K_o \left(1.57 - \frac{.57}{a_o}\right) S V^2$$

$a_o$ representing the relation between the large and the small sides of the rectangle.

$K_o = 45$ in the indicated system where S is expressed in sq.m, V in m/s and R in $Kg_f$ (kilogram force).

What happens in the case if a rectangular surface advances slantingly while only being partially immersed?

Let us assume a rectangular surface immersed under the conditions of FIG. 1, with the parameters explicit (except V, from right to left). Let us call a = 1/L the relation of the transversal side to the longitudinal side of the wet surface. C is the thrust center.

The reactive force, symbolized by $K_r$, has a vertical component $K_y$ and a horizontal one $K_x$. These terms correspond to the coefficients that, multiplied by $SV^2$, give the corresponding component force, S being obviously the wetted surface only.

THE VALUE OF $K_Y$

Two cases must be distinguished:

a. the case when 1>L, i.e. a>one $$K_y = K_o \sin i \cos i \left(1.57 - \frac{.57}{a}\right)$$

i.e. for $i$ 10° and being expressed in degress:

$$K_y \approx .78\, i \left(1.57 - \frac{.57}{a}\right)$$

b. the case when 1<L, i.e. a<one, corresponding to the case of the FIG. 1

$$K_y = K_o(\sin i)^n \cos i\,(1.57 - 0.57a)$$

$n$ is a coefficient whose value is best determined by reference to known empirical tables or curves. In fact $n$ varies only between 2 and 1, and between $a = 0.1$ and $a = 0.8$,it is on the order of 1.2.

THE VALUE OF $K_X$ $K_x$ is composed of two terms, of a first with dynamic effect $k_x$ and equal to $K_y$ tan i and another, $k_f$ of friction, the law of which is not simple.

A sufficient approximation consists, introducing the term VL, product of the speed and the wetted length, in formulating:

$$k_f = \frac{.28\,(1 - 9\sin^2 i}{(VL)^{.15}}$$

The initial coefficient 0.28 would correspond to a "good" state of the hull. For an exceptional polish it could be replaced by 0.22. We have no documentation upon the "poor" states of the hull and their improvement is not of the mathematical domain. The distance d from the center of thrust to the rear edge of the plate is defined by the relationship: $d/L = .75 - .25 \sin i$ It can be seen that this relationship (d/L) varies little with the angle *i*.

The relationship of buoyancy-drag is usually called "finesse" and is represented by the expression $f = K_y/K_x$. FIG. 2 shows the relationship f as a function of the incidence angle *i*. It can be seen that for an optimum angle i of about 4.5°, a maximum value of *f* slightly in excess of 7 is obtained. That is to say that at this optimum angle the drag is reduced to a minimum. To obtain acceptable performances, one must not go below 90 percent of the optimal "finesse" and the angle *i* must therefore be within 3° to 7°.

It is also known that various losses may considerably diminish the finesse factor *f*. Such losses include those caused by nautical appendages from the hull which are immersed in the water, such as rudder, shaft support arm, propeller shaft and the like. These apendages cause an additional drag which adds to the $K_x$ factor of the hull to further diminish the finesse factor f. This drag or braking force increases in hydroplaning with the square of the speed of the hull and thus constitutes a major disadvantage. Other losses are due to unnecessary turbulence, in particular the wash left behind by a hull which constitutes a considerable energy loss. These losses are reduced for vessels that operate as hydroplanes.

The hulls of the prior art, such as those described in U.S. Pat. No. 3,158,125 to Malmberg and U.S. Pat. No. 3,085,535 to Hunt do not accommodate or permit an acceptable angle of incidence *i* without loss of their necessary lateral and longitudinal stability. Also, their angle i varies according to their mode of navigation (i.e. normal navigation or hydroplane navigation), and their angle i attains very poor values in the areas of transition from one mode to the other (as described hereinafter with regard to FIGS. 9 and 10).

A species of multi-hulled vessels is known in the prior art which involves a central hull provided with two lateral floats, such as shown in U.S. Pat. Nos. 3,495,563 to Reischmann and 3,528,380 to Yost. Such devices possess the same disadvantages discussed above with respect to stable optimal angle of incidence, and they also incur considerable losses due to unnecessary turbulences.

SUMMARY OF THE INVENTION:

The present invention overcomes the above briefly discussed and other deficiencies and disadvantages of the prior art by providing a novel hull design for multi-hulled vessles intended for navigation under hydroplane conditions.

The hull design in accordance with the present invention is characterized by a structure which is easy to fabricate. Each of the lateral walls of each hull of a multi-hulled vessel in accordance with the present invention consists of a planar portion extending forwardly from the stern of the hull and a conically shaped front portion which is tangent to the rearwardly positioned planar portion. Each hull, accordingly, includes a pair of oppositely disposed conical front portions which are interconnected at an acute angle by a common generatrix which defines the front stem of the hull.

The lower or base part of each hull in accordance with the preferred configuration of the present invention is defined by a cylindrical segment for the forward portion having a horizontal generatrix. The lower part of each hull further has a planar rear portion with a slightly forward positive gradient. The cylindrical front portion is tangent to the planar rear portion and has a positive gradient which progressively increases in the forward direction.

A multi-hulled nautical vessel in accordance with the present invention is constituted by at least three elemental hulls of substantially hydrostatically and hydrodynamically identical construction connected with each other to form a buoyant polygon having a centrally disposed longitudinal axis of symmetry, i.e., the axis of symmetry extends in the direction from the rear to the front of the vessel. The multi-hulled vessel of the present invention is a fast, stable and economical vessel which, when compared with the speed and cost of the prior art vessels, has higher stability and lower cost. Particular features and advantages of the present invention are found in the conception of a multi-hulled vessel, driven by a standard propulsion element and featuring:

a. A plurality of substantially hydrostatically and hydrodynamically identical hull components designed strictly for their functioning;
b. A general structure capable of very high speeds at calm sea, but maintaining excellent performance characteristics in a sea of only mediocre clamness; and
c. A very stable but yet maneuverable structure at all speeds.

BRIEF DESCRIPTION OF THE DRAWING:

The present invention may be better understood and its numerous objects and advantages will be apparent to those skilled in the art by reference to the accompanying drawings wherein like elements are numbered or identified alike in the several figures:

FIGS. 8-1 through 8-4 are schematic plan views of alternate ways of construction of a vessel according to the present invention.

FIG. 8-5 is a schematic elevation sectional view of a variant of hull construction.

FIGS. 9-1 through 9-3 show schematically the two modes of navigation and the transition therebetween of a single hulled vessel of the prior art.

FIGS. 10-1 and 10-2 are graphs showing horizontal reaction and incidence angle, respectively, relating to vessels shown in FIGS. 9-1 through 9-3.

FIG. 11-1 is a graph showing vertical forces as a function of speed for a vessel in accordance with the present invention.

FIG. 11-2 is a graph showing horizontal forces as a function of speed for a vessel in accordance with the present invention.

In FIGS. 3–5, the parts of the elementary hull are designated by the letters A through M which correspond to the same places in all three views, with a prime (′) superscript being employed in FIG. 4 and a double prime (″) superscript being employed in FIG. 5.

Figure 3:
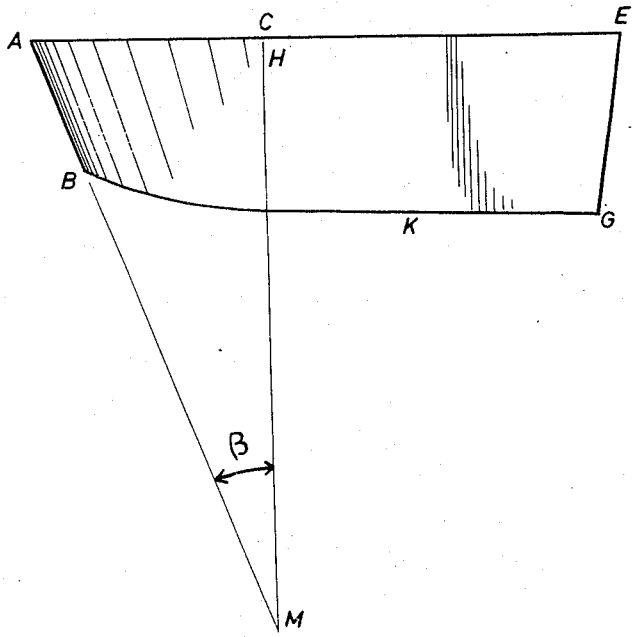
FIG. 3 is a schematic side elevation view of one elementary hull for a multi-hulled vessel in accordance with the present invention.
Figure 4:
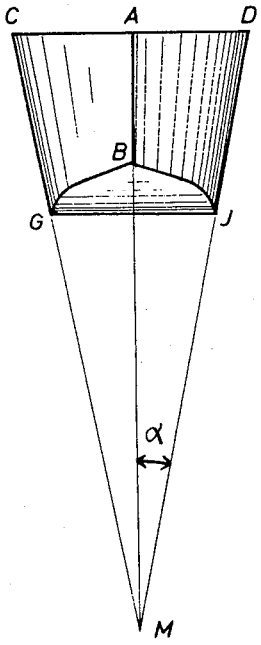
FIG. 4 is a front elevation view of the hull of FIG. 3.
Figure 5:
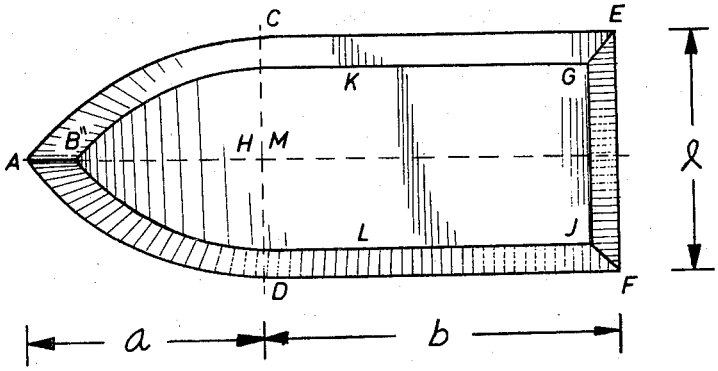
FIG. 5 is a bottom view of the hull of FIGS. 3 and 4.

DESCRIPTION OF THE PREFERRED EMBODIMENT:

Referring jointly to FIGS. 3–5, the upper plane of a hull designed in accordance with the teachings of the present invention is delimited by the points A, C, E, F, and D. The hull has a pair of parallel, lateral top side edges CE and DF and a top rear or stern edge EF which is perpendicular to the said lateral side edges. The upper plane of the hull is completed by an ogival front edge CAD which is defined by arcs AC and AD. The arcs AC and AD are symmetrical with respect to a plane AH through the median of the hull and are respectively tangent to top edges CE and DF at points C and D as shown.

The stern of the hull is planar and is delimited by the points EGJF. As may best be seen from FIG. 3, the rear plane EGJF forms an angle of less than 90° with the upper horizontal plane defined by points ACEDF.

The sides of a hull in accordance with the present invention are in part defined by planar surfaces. Thus, for the port side of the hull, the lateral planar surface extends downwardly from edge DF. On the starboard side of the hull the lateral side plane extends downwardly from edge CE. Both planar side portions of the hull form an angle of less than 90° with the upper horizontal plane ACEFD as shown in FIG. 4. The planar hull side portions extend forward from the stern to a plane passing through the points C and D and perpendicular to the plane of symmetry of the hull. The forward portions of the hull side surfaces are defined by symmetrical conical surfaces which are tangent to said planar side portions. These symmetrical conical surfaces terminate in a common generatrix AB which forms the cutwater or bow of the hull. The geometrical definition of each of the symmetrical conical surfaces is as follows:

1. The intersection of the planar side portions with a plane perpendicular to the plane of symmetry of the hull passes through points C and D and is defined by concurrent straight lines CM and DM.
2. The point of intersection M of lines CM and DM is the apex of the two conical surfaces which define the generatrix MA.
3. EF = 1 (the maximum upper width of the hull).
4. AH = $a$ (the length of the upper ogival portion).
5. CE = DF = $b$ (the length of the upper straight portion of the hull).
6. $\alpha$ = the angle HMC.
7. $\beta$ = the angle HMA. The above quantities are interrelated by the equation:

$$\tan\beta = \frac{2a}{l} \tan \alpha \qquad (1)$$

From the preceding it may be seen that the geometrical shape of the edges of a hull in accordance with the present invention is independent of the shape of the base of the hull. The interconnecting contour between the lower surface and the side surfaces is delimited by the points BKGJL. The forward portion of the base of the hull is thus a horizontal cylindrical surface which is projected onto the line BK. This cylindrical surface is tangent to a planar rear hull portion KGJL which has a positive gradient towards the front of the hull; the curved zone or forward portion of the base of the hull being tangent to planar portion KGJL and the curved forward hull base portion having a positive gradient which increases progressively towards the bow end of the hull.

As will be noted by those skilled in the art, the floatability yield, i.e., the volume of the hull for a given deck surface and a given overall height, is considerable in accordance with the present design due to the fact that the lateral and rear angles of the hull with respect to the vertical can be small and the greater portion of the base of the hull will have a small gradient with respect to a horizontal plane. During slow speed operation a hull in accordance with the present invention behaves essentially in the manner of a longitudinal hull with a conventional front stem and there is little increase in drag at low speeds owing to the slight angle of the lower part of the keel in the forward direction. When speed increases the bottom part of each hull causes a substantially direct vertical upward movement in a step like manner of the vessel due to the portion with the progressively increasing gradient BK and also due to a hydrogliding action on portion KGJL which has the slight positive gradient.

A significant feature of the invention is that a hull in accordance with the present design consists only of planar, conical or cylindrical surfaces which can be easily developed and which do not of necessity have to be produced by stamping or molding.

A nautical vessel constructed in accordance with the present invention contains at least three identical hulls or shells of the construction shown in FIGS. 3–5. By "identical hulls" it is meant that the hulls are hydrostatically and hydrodynamically equivalent, i.e. their performances are equivalent even though they may be slightly different in size, shape or configuration. The hulls are connected together to form a floating polygon having an axis of symmetry longitudinally disposed along the center of the structure extending from the rear to the front, that axis also being the axis of symmetry of the central hull in this configuration.

Figure 6:
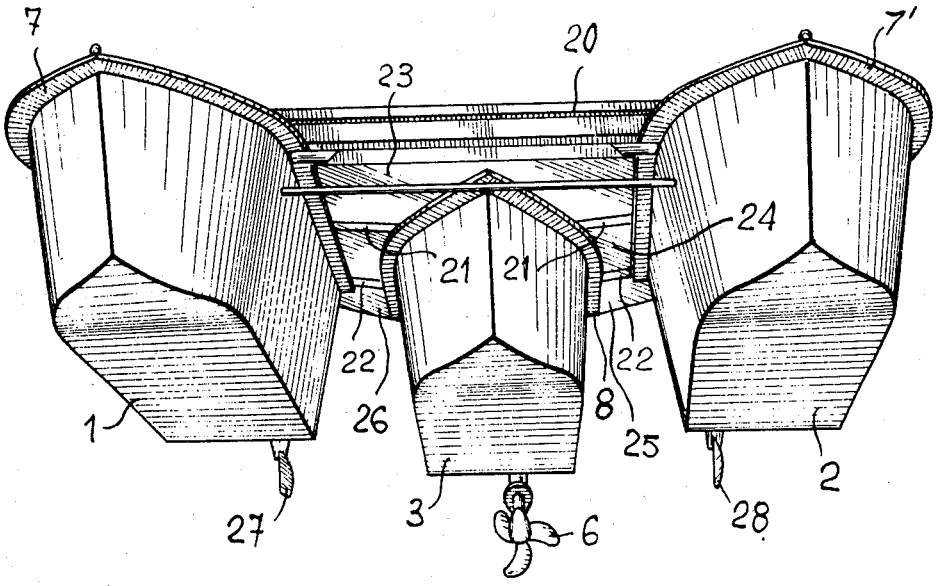
FIG. 6 is a perspective view, viewed from the bottom, of a preferred way of connecting a plurality of elemental hulls of the present invention to form a three hulled vessel in accordance with the present invention.
Figure 7:
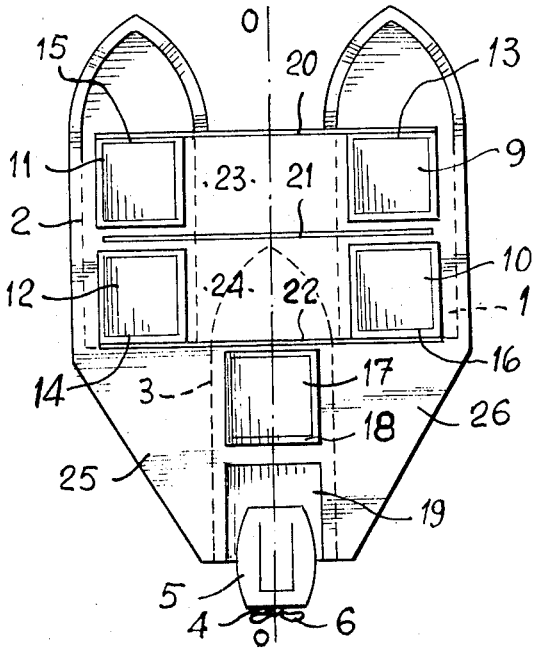
FIG. 7 is a top plan view of the vessel shown in FIG. 6.

FIGS. 6 and 7 show a preferred mode of construction of the multi-shelled nautical vessel in accordance with the present invention. This vessel contains three shells, shells 1, 2 and 3 arranged in the general configuration of an isosceles triangle, with the point of the triangle toward the rear of the vessel. Hulls 1 and 2 are thus located symmetrically with respect to the longitudinal axis of symmetry 0—0 which coincides with and extends along the longitudinal axis of the central hull 3. The central rear hull 3 carries at its rear end a propulsive unit 4 composed of an outboard motor 5 driving a propeller 6. The three shells 1, 2 and 3 are closed at the top by respective horizontal decks 7, 7′ and 8. The decks 7 and 7′ of the outer hulls 1 and 2 have openings 9 and 10 and 11 and 12, respectively, which can be closed by respective covers or hatchways 13, 14 and 15, 16. The deck 8 of rear central shell 3 also has an opening 17 closed by a cover or hatchway 18 and a hollow housing 19 which serves as the site for motor 5. The decks 7, 7′ and 8 of the three shells are connected to each other by three transverse beams 20, 21 and 22 and two rectangular panels 23 and 24. The rear of the outer hulls 1 and 2 is, in addition, connected to the corresponding lateral sides of the deck of central hull 3 by generally triangular shaped panels 25 and 26, respectively. Thus, a large deck surface is obtained allowing easy access to the various openings or gangways 9–12 and to the motor 5. In addition, each of the outer shells 1 and 2 may carry a stabilizer, 27 and 28, respectively. The vessel described above with respect to FIGS. 6 and 7 presents very advantageous navigational features, both in normal navigation and as well as in hydroplaning.

Figure 1:
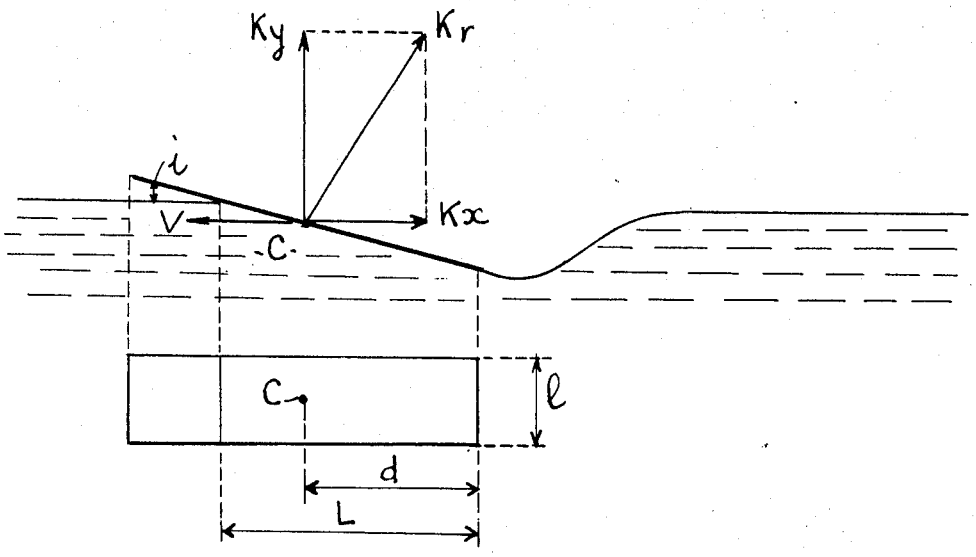
FIG. 1 is a diagrammatic representation, for purposes of analysis, of a flat plate partially immersed in water.
Figure 2:
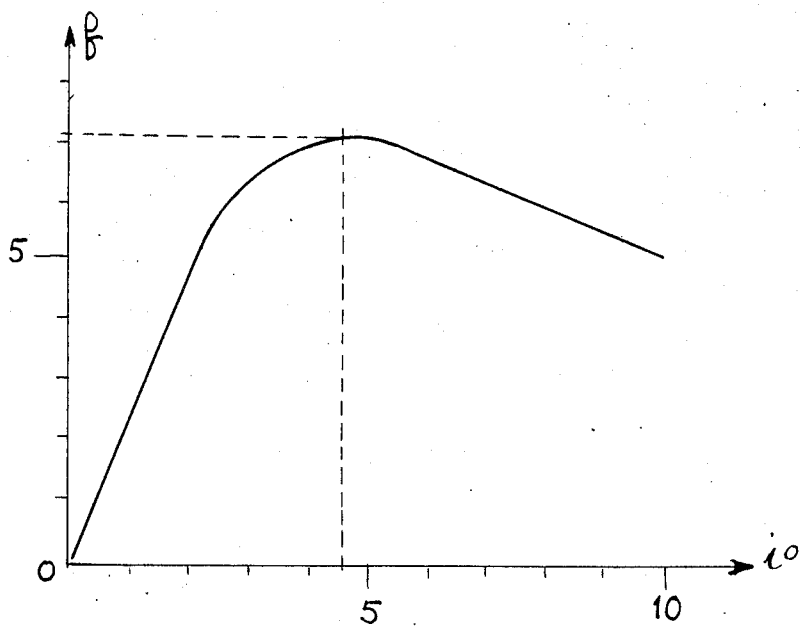
FIG. 2 is a graph of i (angle of incidence) versus f (finesse).
Figures 1, 11:
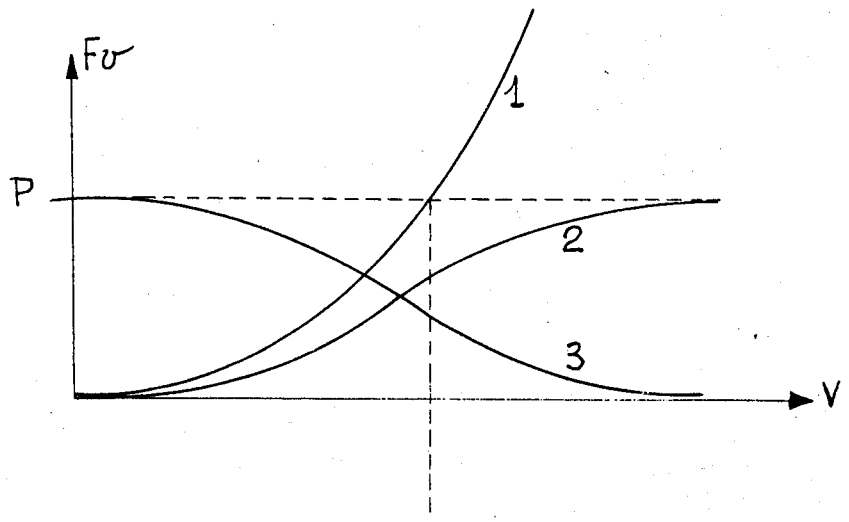
Figures 2, 11:
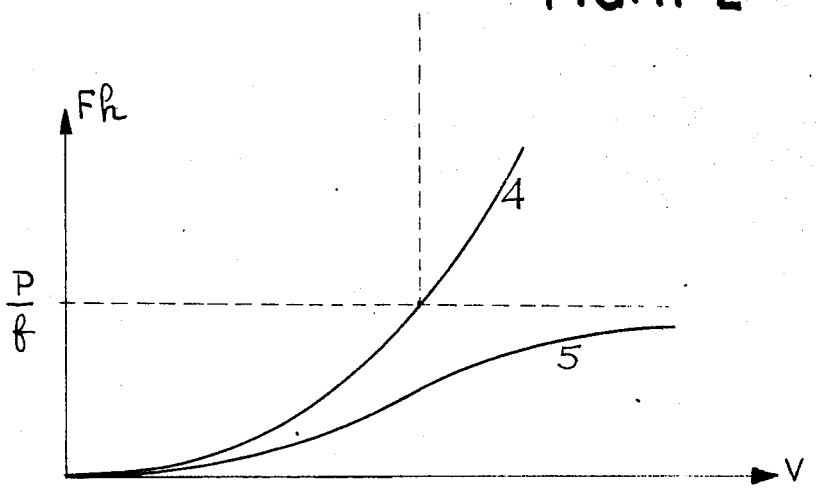

So as to better understand the advantages of the present invention, a discussion will now be presented of the passage from the normal (i.e. conventional) navigational mode to the hydroplaning mode in a single hulled vessel of the prior art, with reference being had to the various parts of FIGS. 9 and 10, and the present invention will then be discussed with regard to FIGS. 11-1 and 11-2.

Referring to FIG. 9-1, a single hulled vessel of the prior art capable of navigating as a hydroplane is shown at rest or in conventional non-hydroplaning operation. The point $P_1$ designates the center of thrust, and G is the center of gravity, $P_1$ and G being located in the classical manner in the same vertical plane. FIG. 9-3 shows the same hull in hydroplaning position and in horizontal trim. In the FIG. 9-3 configuration, the wetted surface of the vessel is very much reduced. R designates the point that received the reaction force $F_r$ in hydroplaning, with the vertical reaction component $F_y$ and horizontal reaction component $F_x$ also being shown. At the point H the propeller exerts a thrust $F_h$ that can be considered to be a horizontal thrust. At the center of gravity G a vertical force is applied, equal to the weight of the vessel (referred to as $M_g$). To obtain a state of equilibrium for the whole vessel, it must be made sure that:

$M_g = F_y$ and $F_h = F_x$ and that the couple ($M_g$, $F_y$) balances the couple ($F_h$, $F_x$)

FIG. 9-2 shows the hull in an intermediate state between the conventional and hydroplaning configurations of FIGS. 9-1 and 9-3 with the relocated center of thrust $P_2$. The state shown in FIG. 9-2 requires an addition of power in comparison with the previous state. When crossing the barrier from the state of FIG. 9-2 to the state of FIG. 9-3, a high power requirement is encountered, but it must be applied very slowly. If an attempt is made to meet this high power requirement with a surge of acceleration, the boat will actually slow down. This is due to the fact that any acceleration tends to cause the boat to nose up because the propeller thrust will necessarily create, in the single shelled configuration, a higher nose up couple. When this acceleration torque causes a nose up of the boat so that, at the same time, the wetted surface increases in size and the drag friction becomes very strong, and the angle of incidence ($i$) comes into zones where the finesse ($f$) is adversely if not disastrously affected, it can be seen that an increase of the propeller thrust, at least in the dynamic sense, will end up in a reduced speed of the boat. The achievement of the hydroplaning state in the prior art occurs only in a gradual transition from the state shown in FIG. 9-2 to that shown in FIG. 9-3 with the front of the boat rising gradually about a rearward pivot point with an increasing angle $i$.

Once hydroplaning has been achieved, it will be noted that any fluctuation in $F_h$, produced voluntarily or involuntarily by the pilot, or any fluctuation in $F_r$ produced by the state of the body of the water (such fluctuations being almost inevitable) will destroy the balance of the couples whereby the boat will nose up or dip. Similarly, such fluctuations will disrupt the balance of forces whereby the boat will accelerate or decelerate. The most spectacular consequences will be those of the disburbances of the couples because when the boat falls back or dips, the boat may knock hard on the surface of the water. Knocking hard will cause the boat to brake and decelerate. In the case of acceleration when the single hulled vehicle is already at a high speed, an increase of the angle of incidence may, in the presence of a squall, result in an aerial couple whereby the angle of incidence ($i$) may reach and pass the value of 90°, i.e. the boat will capsize by backflipping.

The behaviors discussed above are explained with reference to FIGS. 10-1 and 10-2. In FIG. 10-1 there is a representation of the horizontal force $F_x$ as a function of the speed V. The curve OAB is a curve representing a succession of stable states for a boat that may be realized with an acceleration presumed to be infinitely slow. The value P/f is the weight P ($P = M_g$) of the boat divided by the finesse $f$, and P/f equals the horizontal force required for moving the boat in hydroplaning. Similarly, in FIG. 10-2, where the angle of incidence ($i$) is a function of the speed V the cruve $i_o$ab corresponds to the stable state OAB in FIG. 10-1. The critical speed $V_c$ (see FIG. 10-1) corresponds to the maximum propulsive force required (point A) and separates what is usually referred to as the "first state" (curve OA) and the "second state" (curve AB). Similarly, the maximum point $a$ of the stable curve in FIG. 10-2 corresponds to a speed related to the critical speed $V_c$.

Taking one operating point, $M_o$ in FIG. 10-1 and the corresponding point $m_o$ in FIG. 10-2, (the point being in dynamic equilibrium but without secondary derivatives), and supposing that acceleration occurs within a short period of time, the angle of incidence $i$, will increase immediately, and will pass the operating point, $M_o$, $m_o$ to $M_1$, $m_1$. The point $M_1$ is, because of the fact of the increase in the angle of incidence, on a curve $F_x$, V, "costlier" than at the equilibrium angle of incidence of the point $M_o$. True, the thrust $F_x$ demanded from the motor has increased from $M_o$ to $M_1$, but the speed is relatively diminished. A corresponding reasoning will hold true at a rapid deceleration, causing the operating point to pass by $M_o m_o$ to $M_2 m_2$; the consequence of an instantaneous lowering of the trim being that the speed goes up although the thrust $F_x$ demanded from the motor is diminished.

The above discussed problems are even present in single hulled vessels in which there is a good marriage of hull design and propulsive characteristics. The single hulled vessel, even if assuming an ideal angle of incidence in accordance with the relationship of FIG. 10-2, will still suffer, not only from the handicap from dynamic instability, but also from the fact it has to overcome a "hump" of power. That is, even if the curves of operating fluctuations do not involve passage from the points $M_o m_o$ to points like $M_1 m_1$ and $M_2 m_2$, the point A of the curve of FIG. 10-1 must still be overcome. The only way to get beyond point A to B is at a low rate of acceleration. The angle ($i$) changes during the transition and it is only when point B is finally achieved that the proper angle of incidence ($i$) is reached. Therefore, an overpower condition must be demanded from the motor to overcome this power hump which separates the "first state" from the "second state". This overpower requirement imposes penalties in both weight and price. In addition, a propeller adapted to overcome the power "hump" will be poorly adapted for the "second state" that calls for reduced power. Thus, the single shelled vessel incurs another considerable handicap.

To overcome the disadvantages discussed above with respect to single hulled vessels, it has been proposed to use flaps or "trim powers." The flaps are small wings with their axis running perpendicularly to the running direction and giving dynamically an axis couple that is perpendicular to the direction of running. The angle of the flaps is either fixed during maneuvering or adjustable. If the angle is fixed, the use of flaps only demonstrates incorrect design of the hull to which they are affixed; and if they are controllable the flaps cause a sophistication that is heavy in cost and maintenance prices and makes piloting complicated.

The purposes of the "trim power" is to control the angle of the propeller axis with a longitudinal reference with respect to the boat. These devices are expensive and mainly allow one to finely adjust the performance of maximum speed, but they do not change the fundamental handicap of stability of single hulled vessels.

The above discussed considerations are also applicable to multi-hulled vessels of the prior art comprising a central hull and two lateral floaters.

In contrast to the above discussion of problems encountered in the transition from normal navigation to hydroplane navigation in the prior art, the passage from normal navigation to hydroplane navigation with the multi-hulled vessel in accordance with the present invention occurs without any difficulty and, in particular, without any power "hump" or overpower requirements. The angle of incidence ($i$) of the vessel in accordance with the present invention is basically constant at all times during conventional non-hydroplaning operation and during the transition to hydroplaning and during hydroplaning. The transition from conventional operation to hydroplaning operation occurs in a substantially step like vertical upward movement at a constant angle of incidence ($i$). In other words, the whole vessel is lifted directly up into the hydroplaning state. Differences in centering of loads may have a minor effect, but there is no fundamental change in the angle of incidence. According to the formula giving the vertical component of hydroplaning force $F_y = K_y SV^2$, a natural regulation of S (the wetted surface) is obtained - because the vessel cannot "fly away" - but rather there is a whole continuous transition pass between zero velocity (for which the buoyancy is entirely hydrostatic) and the final velocity where the bouyancy is essentially dynamic.

FIG. 11-1 represents the development discussed immediately above. Curve 1 in FIG. 11-1 represents the vertical dynamic force to which a multi-hulled vessel of the present invention would be submitted if its speed were increased from zero to some maximum value while an exterior force held it at the same level in the water, i.e. with the same wetted surface. Curve 2 of FIG. 11-1 represents the component of effective vertical thrust in view of the fact of the actual progressive lift up which occurs. Curve 3 of FIG. 11-1 represents the Archimedeal contribution to buoyance of the vessel. It will be seen that the sum of these two buoyancies, i.e. the buoyancies represented by the curves 2 and 3 of FIG. 11-1, is always equal to the weight of the boat and that curve 2 is asymtotic at a force equal to the weight of the boat and that curve 3 is asymtotic at a zero vertical force. Thus, it can be seen that the incidence angle $i$ remains constant throughout all of the transition from normal navigation to hydroplaning navigation.

FIG. 11-2 represents, paralleling FIG. 11-1, the development of the horizontal forces at work. Curve 4 represents the horizontal forces for "pulling" the boat under the same hypothesis as set forth for curve 1 of FIG. 11-1. At the same speed as curve 1 cut the ordinate P, curve 4 will cut the ordinate P/f. The actual required pulling force is represented by curve 5.

Actual tests have shown that for a vessel corresponding to the preferred embodiment of the present invention curves 2 and 3 of FIG. 11-1 intersect at a speed of approximately 30 kilometers per hour and that this speed is approximately the speed where curve 1 crosses its ordinate at the level P while curve 4 crosses its ordinate at the level P/f.

A vessel constructed in accordance with the present invention therefore presents the following considerable advantages:

a. The individual elementary hulls may be designed with the optimum finesse angle, and this optimum angle is retained during navigation at all speeds.
b. The transition from normal navigation to hydroplaning navigation proceeds in a progressive way without any overpower barrier.
c. The whole of the vessel lifts up at the same time and, consequently, the optimum angle of incidence is maintained at all speeds.
d. The individual elementary hulls avoid losses caused by hull appendages and unnecessary turbulences; the vessel according to the present invention leaves behind itself a calm sea without any appreciable wake; and the hydrodynamic reactions between the individual hulls are negligible.
e. Actual tests have shown that a multi-hulled vessel according to the present invention turns without incident at all speeds keeping an excellent lateral trim stability; all risks of overturning or blocking at full speed by a super christiania are eliminated.
f. The individual elementary hulls present a simple structure containing only easily developable shapes, the construction of which is simple and inexpensive.

Figures 1, 8:
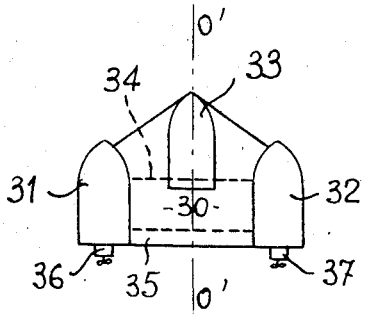
Figures 2, 8:
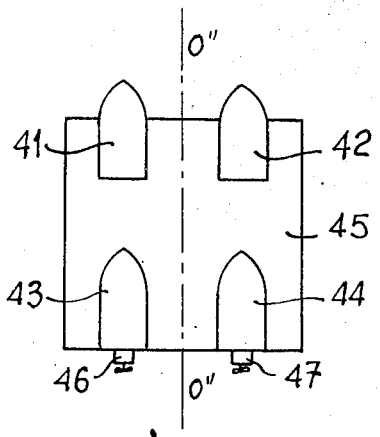
Figures 3, 8:
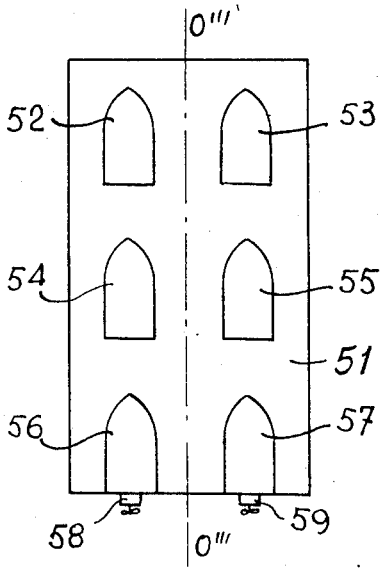
Figures 4, 8:
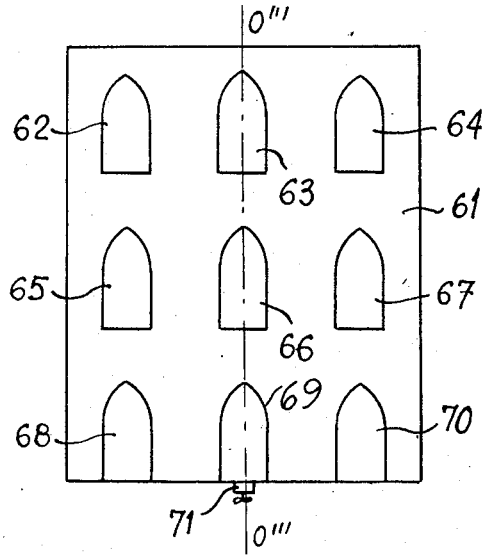
Figures 5, 8:
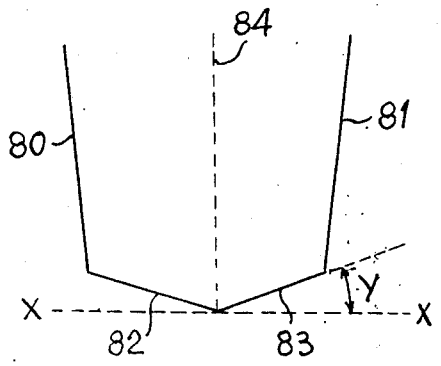

The vessel of the present invention is not limited to the preferred polygon described with respect to FIGS. 6 and 7. Rather, the individual elementary hulls may be located in different arrangements to form buoyant polygons. FIGS. 8-1 through 8-4 show illustrative examples of various polygon shapes formed by arrangements of multiples of the elemental individual hulls of the present invention.

The vessel of FIG. 8-1 has three individual hulls, 31, 32 and 33, located in an isosceles triangle with the point of the triangle toward the front. The vessel is symmetrical with respect to the axis O′ — 0′. The elementary hulls are connected with each other by the beams 34, 35 and a panel 30. In this configuration, the two lateral rear hulls each have propulsive units with propellers 36 and 37.

The configuration of the vessel shown in FIG. 8-2 has two pairs of parallel elementary hulls 41, 42 and 43, 44, respectively, located one pair behind the other. The hulls of this configuration are thus symmetrically located with respect to axis 0'' — 0'' running from the rear of the vessel toward the front of the vessel. The individual hulls of this configuration are fashioned together at their upper decks by a platform 45 which constitutes the deck of the nautical vessel. The deck may, of course, support the usual structures of a nautical vessel. Propulsive units with propellers 46 and 47 are mounted in this case to the rear hulls 43, 44.

FIGS. 8-3 and 8-4 show schematically two other configurations for a vessel in accordance with the present invention containing deck platforms 51 and 61, respectively, supported by a series of individual elementary hulls. In the configuration of FIG. 8-3, three pairs of parallel individual hulls 52–53, 54–55, 56–57, are located behind each other and fastened at their upper surfaces to the lower face of platform 51. The rear hulls 56 and 57 each carry a propulsive unit with propellers 58 and 59. In the configuration of FIG. 8-4, three rows of individual hulls 62-63-64, 65-66-67 and 68-69-70 are located in parallel arrangements behind each other and are fastened by any convenient means to the lower face of platform 61. In this configuration a single propulsive unit with a propeller 71 may be mounted on the middle hull 69 of the rearmost row. In FIG. 8-3 the vessel is symmetrical with respect to axis 0''' — 0''', and in FIG. 8-4 the vessel is symmetrical with respect to axis 0'''' — 0''''.

In each of the configurations 8-1 through 8-4, it will be understood that the individual hulls are structures corresponding to the individual elementary hull shown in FIGS. 3 through 5.

In the preferred form of the individual elementary hull, as shown in FIGS. 3 through 7, the bottom of the individual hull is formed by a single straight line when viewed in transverse section. According to a variation, the bottom of the individual hull may be constituted of two walls that are symmetrical with respect to the general plane symmetry of the hull, and these two walls define between themselves a slight dihedral. This variation is schematically represented in FIG. 8-5 which shows a schematic cross-section of the rear part of the hull. As shown in FIG. 8-5, the lateral of sidewalls 80, 81 of an elementary hull and the bottom surfaces 82, 83 are shown. The bottom in this case is constituted by two inclined planes 82, 83 which meet at the longitudinal axis 84 of the hull. The bottom surfaces 82 and 83 are each formed of a rear planar part and a forward arcuate cylinder part tangent to the rear planar part. The surfaces 82, 83 are inclined with respect to the horizontal ($x$) by a slight angle $y$. In accordance with the present invention, the angle $y$ must be very small, being in a range of less than or equal to 6°. If angle $y$ goes beyond 6°, unacceptable buoyancy losses, similar to the prior art, will be encountered. It should, however, be specifically noted that the small angle $y$ which is permitted in accordance with the present invention does not result in a hull which can be compared in any way with prior art generally V-shaped hulls.

While preferred embodiments have been shown and described, various modifications and substitutions may be made thereto without departing from the spirit and scope of the invention. Accordingly, the present invention has been described by way of illustration and not limitation.

What is claimed is:

1. A multi-hulled nautical vessel especially suitable for hydroplane navigation, including:

at least three hulls of substantially identical construction; and means connecting said hulls together to form a polygon shaped support structure having a front and rear, said polygon having an axis of symmetry extending from the rear to the front of the vessel;

each hull having a stern, a base and a pair of lateral sidewalls, and each hull having a vertical longitudinal plane of symmetry;

each of said lateral sidewalls having a rear planar portion extending forwardly from said stern and a front conical portion tangentially connected to said rear planar portion, said front conical portions of each pair of lateral sidewalls being connected to each other at an acute angle by a common generatrix forming the cutwater of the hull;

each part of the base of each hull about the vertical longitudinal plane of symmetry of the hull being a surface having a rear portion extending forwardly from said stern with a positive gradient to form an angle of incidence of from about 3° to 7° and a front portion tangentially connected to said rear portion and extending forwardly with a progressively increasing positive gradient;

said parts of the surface of said base of each hull meeting at the vertical plane of symmetry of the hull at a dihedral angle of from 168° to 180°.

2. A nautical vessel as in claim 1 wherein:

said dihedral angle between said surfaces of the base of each hull is 180°, whereby said surfaces of the base of each hull merge into a single surface defined by horizontal generatrices.

3. A nautical vessel as in claim 1 wherein:

said vessel has a loss of finesse not greater than 10 percent of the theoretical maximum finesse of hydroplaning navigation.

4. A nautical vessel as in claim 1 wherein:

the load of the vessel is distributed substantially equally to each of the hulls.

5. A nautical vessel as in claim 1 including:

propulsive means mounted on said vessel symmetrically with respect to said axis of symmetry.

6. A nautical vessel as in claim 1 wherein:

said hulls are arranged with two rear hulls and one front hull to form an isosceles triangle with its point toward the front; and including:

propulsive means on each rear hull.

7. A nautical vessel as in claim 1 wherein:

said hulls are arranged with one rear hull and two front hulls to form an isosceles triangle with its point toward the rear; and including:

propulsive means on each rear hull.

8. A nautical vessel as in claim 1 wherein the vessel includes:

at least two rows of said hulls, with each row having at least two of said hulls, the rows being arranged from the front to the rear of the vessel.

9. A nautical vessel as in claim 8 wherein:

the rearmost row has an even number of hulls; and including:

propulsive means on at least two of said hulls in the rear row symmetric with said axis.

10. A nautical vessel as in claim 8 wherein:

the rearmost row has an odd number of hulls; and including:

propulsive means on the central hull of said rearmost row.

11. An elemental hull for a multi-hulled vessel, the elemental hull having a vertical longitudinal plane of symmetry and having:

means defining a stern;

means defining a hull base member connected to and extending forwardly from said stern defining means; and a pair of oppositely disposed sidewalls, said sidewalls being connected to said stern and base member defining means and merging at the end thereof disposed away from the stern portion, each of said sidewalls comprising:

a planar rear portion extending forwardly from the stern portion;

a conical front portion, said conical front portion being tangentially connected to said planar rear portion, said conical front portions of the oppositely disposed sidewalls being interconnected at an acute angle by a common generatrix which defines the front stem of the hull; said base member defining means on each side of said plane of symmetry being a surface comprised of;

a rear base portion having a first end connected to said stern defining means and having side edges connected to the planar rear portions of the oppositely disposed sidewalls, the rear base portion extending toward the stem of the hull and having a positive forward gradient to form an angle of incidence of from about 3° to about 7°; and an arcuate cylindrical base forward position, the arcuate base forward portion being tangent to said rear base portion and having a gradient which progressively increases in the forward direction to the stem of the hull;

said rear base portions and said forward base portions meeting at said vertical plane of symmetry at a dihedral angle of from 168° to 180° along the entire length of said base member.

12. The hull as in claim 11 wherein:

the included angle between said surfaces is 180° to define a single surface defined by horizontal generatrices.

* * * * *